US005301447A

United States Patent [19]

Lotter et al.

[11] Patent Number: 5,301,447

[45] Date of Patent: Apr. 12, 1994

[54] TENSIONING OF FLEXIBLE SHEET

[76] Inventors: Hancil R. Lotter, 44 Prince Charles Drive, Westville, Natal Province; James G. Lowndes, Hillstar Avenue, Wetton, Cape Town, Cape Province, both of South Africa

[21] Appl. No.: 810,829

[22] Filed: Dec. 20, 1991

[30] Foreign Application Priority Data

Dec. 20, 1990 [ZA] South Africa ..... 90/10291

[51] Int. Cl.[5] ..... G09F 17/00

[52] U.S. Cl. ..... 40/603; 40/574; 160/328; 160/378; 38/102.91

[58] Field of Search ..... 40/156, 574, 603, 604; 160/327, 328, 378, 387; 38/102.91

[56] References Cited

U.S. PATENT DOCUMENTS

| | | | |
|---|---|---|---|
| 2,704,415 | 3/1955 | Shiffman | 38/102.91 |
| 4,409,749 | 10/1983 | Hamu | 160/378 X |
| 4,937,961 | 7/1990 | Gandy et al. | 38/102.91 X |
| 4,955,928 | 9/1990 | Tanner | 40/603 |
| 5,046,545 | 9/1991 | Loomis et al. | 38/102.91 X |

FOREIGN PATENT DOCUMENTS

| | | | |
|---|---|---|---|
| 132305 | 1/1985 | European Pat. Off. | 40/603 |

*Primary Examiner*—Brian K. Green

*Attorney, Agent, or Firm*—Ladas & Parry

[57] ABSTRACT

A display sign of box-like construction has internal illumination and a face comprising a transparent or translucent sheet with advertising material applied thereto. The face is tensioned by means of a locking element to which the face is attached and which is then forced into the gap between two surfaces. The element is serrated and one of said surfaces includes a detent which co-operates with the serrations. The pull exerted by the tensioned face pulls the locking element into a position in which it lies skew to said surfaces and bears on both said surfaces with the detent between adjacent serrations. There can be one or more locking elements along each edge of the sheet, or one or more locking elements along one edge of the sheet only. The sheet can be tensioned by locking elements acting in two directions which are at right angles to one another.

4 Claims, 3 Drawing Sheets

TENSIONING OF FLEXIBLE SHEET

FIELD OF INVENTION

This invention relates to the tensioning of a flexible sheet and particularly, but not exclusively, to the tensioning of a flexible sheet used as the face in an advertising sign.

BACKGROUND TO THE INVENTION

One form of advertising sign comprises a rectangular frame with a flexible sheet of material stretched across the frame. The advertisement is on the sheet which is usually backlighted. The sheet must be tensioned to remove all wrinkles, wrinkles detracting from the appearance of the sign. Desirably, the sign is also able to compensate for dimensional changes in the sheet if the sheet is heated up. This is a particular problem in outdoor signs where the temperature of the sign changes considerably depending on whether or not it is being subjected to direct sunlight.

OBJECTS OF THE INVENTION

The main object of the present invention is to provide a sheet tensioning system which is simple in construction and simple to use.

Another object of the present invention is to provide a mounting system for a tensioned flexible sheet which system is able to compensate for temperature induced dimensional changes in the tensioned flexible sheet.

A further object of the present invention is to provide a flexible sheet at least two opposed edges of which are adapted for use with a tensioning system in accordance with the present invention.

SUMMARY OF THE INVENTION

According to one aspect of the present invention there is provided a structure for tensioning a flexible sheet, the structure comprising a detent and a backing surface which are spaced apart and define a mouth therebetween, a locking element for insertion into said mouth from outside the mouth, said locking element having an area comprising a series of teeth which cooperate with said detent and also having an anchorage to which an edge of said sheet is secured with the sheet extending from said anchorage and through said mouth, the pull exerted by said sheet on said locking element urging said element to a position in which it bears on said backing surface and, by way of said teeth, on said detent and is wedged between the two with the detent engaged with one of said series of teeth.

In the preferred form the detent comprises a body portion with a groove in it, said groove receiving said edge of said sheet and forming said anchorage, a surface of said body portion adjacent said groove bearing on said backing surface, and a limb extending away from said body portion, the toothed area being on said limb.

To increase the possible range of adjustment, two opposed edges of said sheet can be attached to locking elements, the locking elements being between respective detents and backing surfaces.

As a single elongate locking element is difficult to manipulate, said edge of said sheet can be anchored to a series of locking elements arranged side-by-side and each of which is between said detent and said backing surface, said detent and backing surface being part of an elongate element of the structure.

The structure preferably comprises a first elongate frame element, a second elongate frame element parallel to and spaced from the first element, said first frame element including said detent and said backing surface, the second frame element including an anchorage for said sheet, and at least one locking element between said detent and said backing surface of said first frame element, said sheet extending between the anchorage of the locking element and the anchorage of said second frame element.

The second frame element can include a groove which receives said edge of said sheet and forms said anchorage.

According to a further aspect of the present invention there is provided a display sign including a flexible face, means for mounting the face, and means for compensating for any dimensional changes of the face which are induced by temperature variations, said means comprising a bar which is resiliently urged against said face and which constantly maintains a tensioning force on said face.

In the preferred form said means comprises a resiliently flexible element which presses against said face and which is permanently deflected by said face from its undeformed condition whereby said element exerts a permanent tensioning force on the face.

According to another aspect of the present invention there is provided a face for a display sign which face comprises a sheet of flexible material with at least two opposed edge zones thereof folded over and secured to the remainder of the sheet thereby to form sleeves along the edges of the sheet, there being cords in and extending along the sleeves which cords prevent the sleeves being flattened, the sleeves and cords forming anchoring means for the face.

BRIEF DESCRIPTION OF THE DRAWINGS

For a better understanding of the present invention, and to show how the same may be carried into effect, reference will now be made, by way of example, to the accompanying drawings in which.

DESCRIPTION OF THE PREFERRED EMBODIMENT

Figure 1:
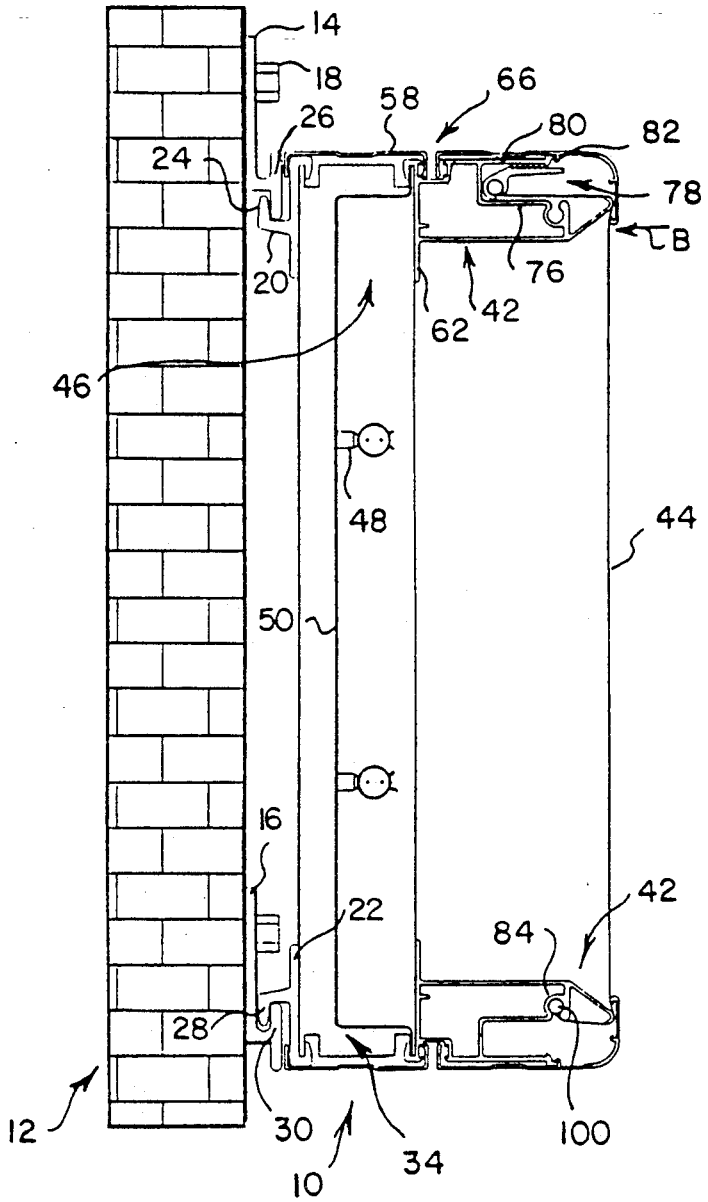
FIG. 1 is a vertical section through an advertising sign in accordance with the present invention.

The advertising sign 10 which is illustrated is shown mounted on a wall 12 by means of identical upper and lower brackets 14 and 16 secured by fastening bolts 18 to the wall 12. On the rear of the sign 10 there are two hooks 20 and 22, the hooks being identical to one another but inverted with respect to one another. Each hook 20, 22 includes a lip, the lip 24 of the upper hook 20 hooking behind a depending flange 26 of the upper bracket 14 and the lip 28 of the lower hook 22 hooking behind an upstanding flange 30 of the lower bracket 16. It will be understood that the sign 10 is mounted on the brackets 14 and 16 by sliding it sideways with respect to the brackets so that it is supported by the lower brackets 16 and prevented by the upper brackets 14 from tilting forwardly away from the wall 12.

At least two upper brackets 14, two lower brackets 16, two hooks 20 and two hooks 22 are provided for supporting the sign 10. If the sign is particularly large then three or more brackets 14 etc., can be provided. In the illustrated embodiment it is assumed that the sign is of a size such that two brackets 14, two brackets 16 etc., are sufficient for support purposes.

Figure 3:
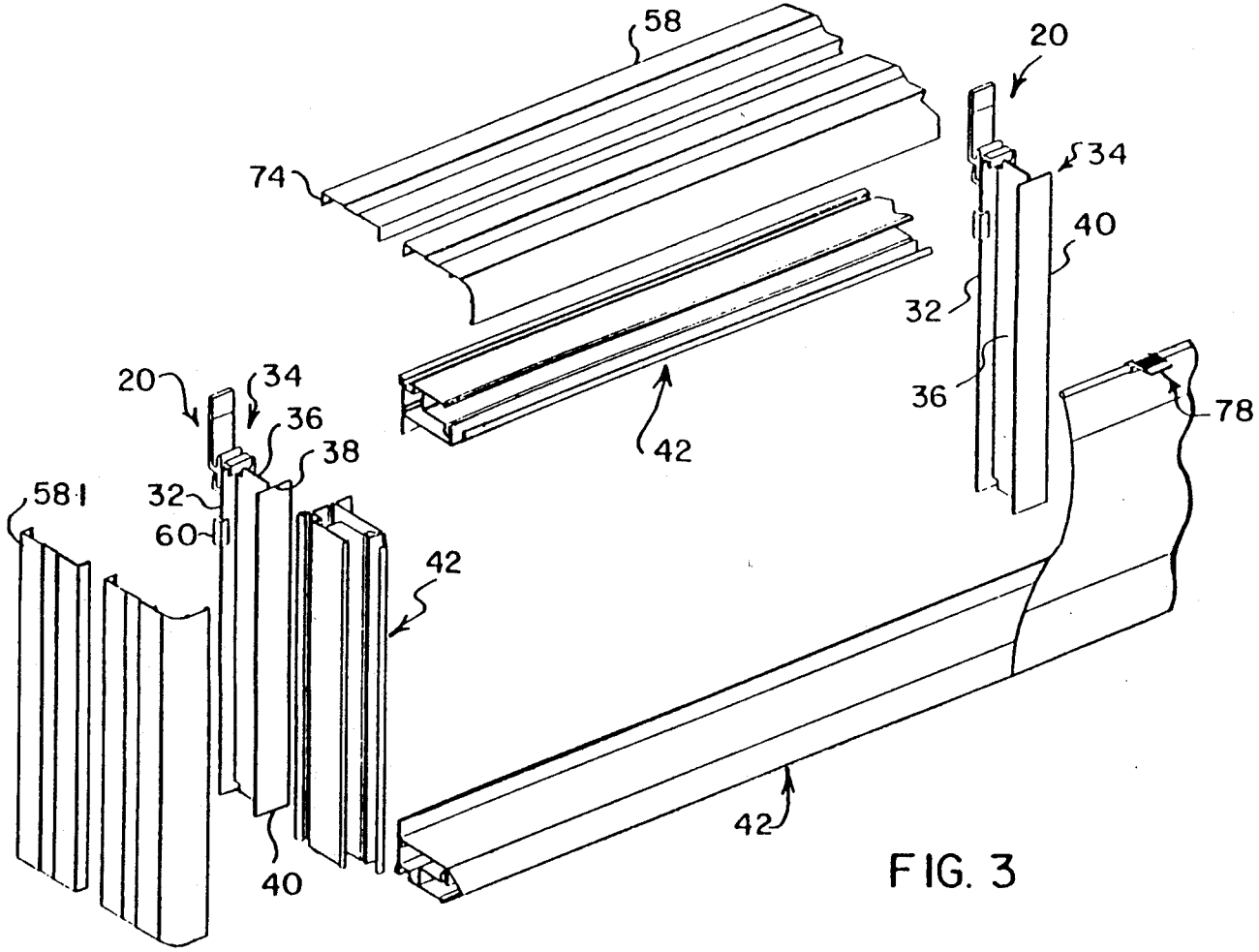
FIG. 3 is an exploded view of the sign.

If reference is made to FIG. 3 it will be noted that the hooks 20 are mounted on the rear flanges 32 of I-beams designated 34. The webs of the I-beams are designated 36 and are cut away at their upper and lower ends in the regions designated 38. The other flanges of the I-beams 34 are designated 40.

Reference numerals 42 denote aluminium extrusions which form the top and bottom horizontals and the vertical sides of a rectangular frame which is composed of four lengths of the extrusion 42. The four lengths are connected together at the corners by way of mitered joints. The lower extrusion 42 of the frame is inverted with respect to the upper extrusion 42. The frame is open at the front, that is, at the right hand side as viewed in FIG. 1 and a flexible sheet 44 is stretched across the open front of the frame. The sheet 44 constitutes a face. The sheet 44 is translucent and has secured thereto decals which constitute the information to be displayed. The information may be the name of a trading establishment, an advertising slogan or any other information. The preferred form of sheet 44 comprises a woven scrim which is embedded in translucent or transparent synthetic plastics material.

In the space designated 46 there is an array of lights 48, the lights shining through the sheet 44. The lights 48 are florescent tubes which are carried by a lighting module 50. The lighting system forms the subject of our copending application filed simultaneously.

Two covers 58 (only the upper one of which is shown in FIG. 3) clip onto the extrusions 42 and the hooks 20 and close-off the top and bottom of the space 46. The sides of the space 46 are close-off by covers 58.1 which clip onto the vertical extrusions 42 and elements 60 (FIG. 3) which are secured to the flanges 32 of the I-beam 34.

Each extrusion 42 is of box configuration and includes a flange 62 and a hook 64. The hooks 64 of the upper and lower extrusions engage top and bottom edges of the front flanges 40 of the I-beams 34 and the hooks 64 of the vertical extrusions 42 receive the edges of the front flanges 40 as will be seen from FIG. 3. All the extrusions 42 are secured to the webs 40 of the I-beams 34 by self tapping screws or other fastening elements (not shown).

Each extrusion 42 also includes a channel designated 66 which receives a clip 68 of one of the covers 58, 58.1 and a clip 70 forming part of a further cover 72. Each cover 58 further includes a clip 74 which engages with a respective bracket 20, 22.

As all the extrusions 42 are identical only the upper extrusion 42 will now be further described in detail. A second member 76 of the "box" forms a backing surface for locking elements generally indicated at 78. Above the horizontal second member 76 the extrusion has a first member in the form of an overhanging arm 80 on the free end of which there is a detent 82. The first and second members are spaced apart and define a cavity therebetween. Each of the members have an edge and the space between the edges of the members form a mouth which creates an entrance to the cavity. An upwardly open groove 84 is provided at the front end of the horizontal 76 and just rearwardly of the front wall 86 of the box. The groove 86 is more than semi-circular in extent.

The extrusion 42 has a lip 88, the lip 88 being on the outer end of a limb 90 which can flex as shown by arrow D.

The cover 72 includes, on the under surface thereof, a clip 92. The clip 92 co-operates with the upper part of the detent 82 (see FIG. 2) and, in conjunction with the clip 70, holds the cover 72 in place. On the lower edge of the vertical limb of the cover 72 there is a lip 94 having a curved front face, the lip 94 being below the lip 88. It will be noted that the sheet 44 passes between the lips 88 and 94.

Each element 78 has a serrated upper surface thereby providing a series of teeth designated 96 which co-operate with the detent 82. The element 78 also includes a groove 98 which opens downwardly through the lower face of the element 78. The groove 98 is more than semi-circular in extent. It will be noted that each tooth 96 has an inclined ramp surface with which the detent 82 co-operates as the element 78 moves to the left (FIG. 2) and an almost vertical locking surface with which the detent 82 comes into co-operation as it moves over the crest of each tooth 96 during movement to the left.

The sheet 44 is prepared for attachment to the casing by placing a cord (designated 100) along each edge thereof. The edge zones of the sheet are then folded over on themselves to form sleeves through which the cords 100 run. The juxtaposed strips of the sheet are then ultrasonically welded to one another or stitched to enclose the cords. It will be understood that each cord 100 and the associated turned-over edge zone of the sheet form anchoring means which can be slid axially through any of the grooves 84 and 98 but which cannot pull out through the mouth of the grooves.

Figure 4:
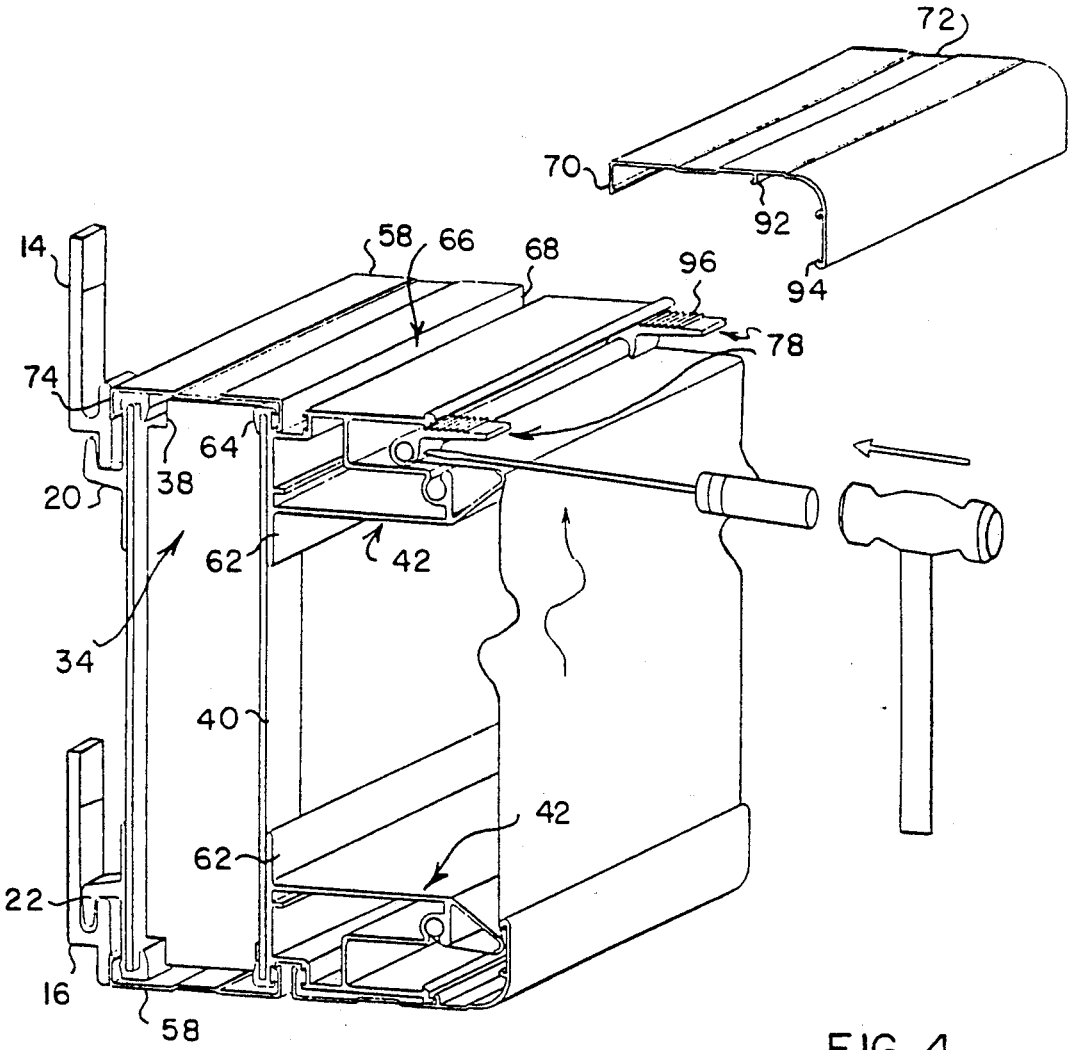
FIG. 4 is a pictorial view illustrating the face tensioning procedure.

To anchor the top and bottom edges of the sheet 44, and to tension the same, the anchoring means constituted by the lower edge zone and cord 100 are fed through the groove 84 of the lower extrusion 42. As illustrated in FIGS. 1 and 4, because the extrusion 42 forming the lower part of the frame is inverted with respect to the upper extrusion 42, the sheet 44 passes downwardly out of the groove 84, over the lips 88 and 94 and then upwardly towards the upper extrusion.

Figure 2:
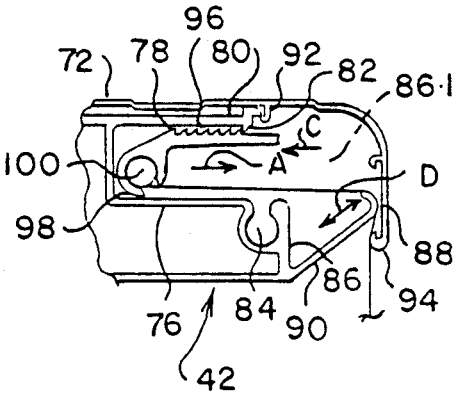
FIG. 2 is a detail, to a larger scale, of part of the sign of FIG. 1.

The upper anchoring means of the sheet 44 is fed along the groove 98 of the element 78, it being assumed for the purposes of the following description that there is only a single element 78. Thereafter the element 78 is pushed back into the mouth defined between the horizontal second member 76 and the detent 82. Until an initial tension has been applied to the sheet 44, the element 78 can simply be pushed into the mouth by hand. As soon as there is tension in the vertical direction on the sheet 44, a pull is exerted on the element 78 in the direction indicated by the arrow A (FIG. 2). Thus the element 78 tends to pivot in an anti-clockwise direction, as illustrated in the drawings, and is wedged between the horizontal second member 76 and the detent 82. The element (78) makes contact with a bearing surface of the horizontal second member (76). The detent 82 is engaged with the vertical surface of one of the teeth 96 and hence cannot move to the right out of the mouth.

To apply the desired degree of tension to the sheet 12, the element 78 has to be displaced to the left in a step wise manner so that the detent 82 successively passes over more of the teeth 96. It will be understood that once the detent 82 has passed over a tooth 96, the element 78 cannot thereafter move back to the right in view of the pull exerted by the sheet 44 and which tends to pivot the element 78 in the anti-clockwise direction.

The element 78 can be tapped to the left using a small hammer and a screw driver as illustrated in FIG. 4. It is also possible to use a gripping implement of the form of a pair of pliers. More specifically, one limb of the pair of pliers is inserted in the channel 66 or applied to the hook 64 and the other limb is applied to the right hand end of the element 78. When the pliers are squeezed the element 78 moves to the left.

It will be understood that to release the sheet 44 it is merely necessary to press down on the element 78 thereby rotating it in a clockwise direction and disengaging the teeth 96 from the detent 82.

Prior to the cover 72 being fitted, the sheet 44 extends in a straight line between the lips 88. When the cover 72 is fitted, the lip 94 urges the sheet 44 inwardly so that the sheet 44 adopts the zig-zag configuration illustrated.

In the event that the sign is an outdoor sign then it can be subjected to considerable heating. If the sheet 44 heats and stretches then it can wrinkle which spoils its appearance. The vertical limb of the cover 72 is always resiliently deflected outwardly somewhat from its rest position so that it continually exerts a force on the sheet 44 in the direction of the arrow B. Should the sheet 44 be heated and tend to stretch then the vertical limb of the cover 72 moves to the left and takes-up any slack in the sheet 44.

It will be understood that if the sign is short then a single horizontally elongate element 78 can be used. However, once the element 78 becomes of substantial length, it cannot easily be displaced into the mouth whilst being held parallel to the detent 82. The element 78 tends to skew. It is consequently preferred that there be a series of short elements 78 (see FIG. 3) arranged side-by-side along the length of the extrusion 42.

If desired an element 78 or elements 78 can be associated with the lower extrusion 42 and the upper edge of the sheet 44 entered in the groove 84 of the upper extrusion 42. Alternatively, there can be one or more elements 78 associated with the upper extrusion 42 and one or more elements 78 associated with the lower extrusion 42. This latter arrangement provides for a greater degree of adjustment.

One or more elements 78 can be associated with one or both vertical extrusions 42 thereby to tension the sheet 44 in both the vertical and horizontal directions.

Figure 5:
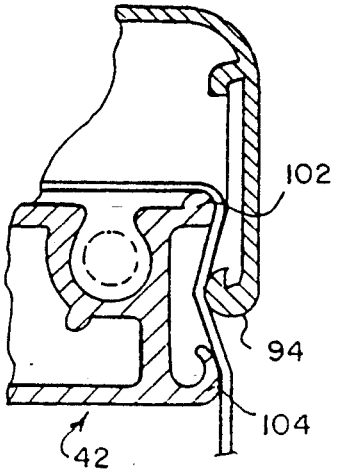
FIG. 5 is a detail illustrating a modification of the sign of FIG. 1.

In the modification of FIG. 5 there are two lips 102 and 104 on the extrusion 44. The lip 102 is above the lip 104 and the lip 94 on the cover is between the lips 102 and 104. The sheet 44 thus follows the zig-zag path illustrated between the three lips.

We claim:

1. A structure including a flexible sheet and means for tensioning the flexible sheet, the structure comprising first and second spaced apart members defining a cavity therebetween, each of said members having an edge, a mouth defined by said edges and forming an entrance to said cavity, locking means on said first member and a bearing surface on said second member, said locking means being closer to said mouth than said bearing surface, a locking element in said cavity between said members, said element including a body, an external face on said body, said face making contact with said bearing surface of said second member along a contact zone and said element being pivotal with respect to said members about said contact zone, said external face providing a means for allowing said element to pivot with respect to said members about said contact zone, a limb protruding from said body, said limb being spaced from said second member and moving towards and away from the first member when said element pivots with respect to said members, locking means on said limb, said locking means on said limb and said locking means on said first member being adapted to lock said limb with respect to said members in any one of a number of locked positions and prevent withdrawal of said element from said cavity through said mouth, said body of said element including an anchorage to which an edge of said sheet is secured with the sheet extending from said anchorage and out of said cavity through said mouth, said sheet having an opposed edge which is outside said cavity, means for anchoring said opposed edge so that said sheet can be tensioned by movement of said element away from said entrance, said sheet, once tensioned by moving said element away from said entrance, exerting a pull on said locking element and pivoting said element about said zone so that said limb moves towards said first member and said element is wedged between said members with said face pressed against said surface and said locking means in engagement with one another.

2. A structure according to claim 1, wherein said edge of the sheet is turned back to form an elongate pocket in which there is a flexible cord, said body having a groove in it, said groove receiving said edge of said sheet and said cord and forming said anchorage, said face being on said body adjacent said groove and said limb extending away from said body, the locking means of said locking element being a toothed area on said limb.

3. A structure according to claim 1, wherein two opposed edges of said sheet are attached to locking elements and the locking elements are between respective first and second frame members.

4. A structure according to claim 1 wherein said edge of said sheet is anchored to a series of locking elements arranged side-by-side and said members are of elongate form.

* * * * *